US005864628A

United States Patent [19]

Posen et al.

[11] Patent Number: 5,864,628

[45] Date of Patent: Jan. 26, 1999

[54] PRESS-FIT SOUND DAMPING STRUCTURE

[75] Inventors: Miles Posen, Glenview; Lawrence M. Posen, Glencoe; Robert S. Yoest, Dearfield, all of Ill.

[73] Assignee: Beltone Electronics Corporation, Chicago, Ill.

[21] Appl. No.: 682,434

[22] Filed: Jul. 17, 1996

Related U.S. Application Data

[63] Continuation-in-part of Ser. No. 378,812, Jan. 27, 1995.

[51] Int. Cl.[6] ..... H04R 25/00

[52] U.S. Cl. ..... 381/325; 381/328; 381/322

[58] Field of Search ..... 381/68.6, 68.7, 381/69, 68; 181/135, 128, 129, 130

[56] References Cited

U.S. PATENT DOCUMENTS

| | | | |
|---|---|---|---|
| 1,830,198 | 1/1931 | French . | |
| 4,296,829 | 10/1981 | Pedersen . | |
| 4,349,082 | 9/1982 | Gastmeier . | |
| 4,443,668 | 4/1984 | Warren . | |
| 4,553,627 | 11/1985 | Gastmeier et al. . | |
| 4,706,778 | 11/1987 | Topholm | 381/68.6 |
| 4,870,689 | 9/1989 | Weiss . | |
| 4,972,488 | 11/1990 | Weiss . | |
| 4,984,277 | 1/1991 | Bisgard et al. . | |
| 4,987,597 | 1/1991 | Haertl . | |
| 5,099,947 | 3/1992 | Guggenberger et al. . | |
| 5,105,904 | 4/1992 | Olsen . | |
| 5,278,360 | 1/1994 | Carbe et al. . | |
| 5,327,500 | 7/1994 | Campbell . | |

FOREIGN PATENT DOCUMENTS

| | | |
|---|---|---|
| 0310866 | 9/1988 | European Pat. Off. . |
| 0352954 | 7/1989 | European Pat. Off. . |
| WO 84/04016 | 10/1984 | France . |
| 415944 | 7/1925 | Germany . |

OTHER PUBLICATIONS

A Drawing and a Data Sheet for a Beltone Optima Hearing Aid with a Removable Threaded Wax Guard on sale in the United States before Jan. 27, 1994.

*Primary Examiner*—Sinh Tran
*Attorney, Agent, or Firm*—Rockey, Milnamow & Katz, Ltd.

[57] ABSTRACT

An acoustic attenuator and wax barrier for a hearing aid includes a substantially cylindrical, color coded, housing having a barbed portion for press-fitting the barrier into position. As the channel diameters increase, an associated peak output frequency also increases for the respective housing. The barrier may include one of a plurality of attenuating or damping screens which provides predetermined sound damping characteristics. Alternately, the barrier may include housings having different acoustic channel diameters to provide the different, predetermined audio attenuation or damping characteristics. The barrier is field changeable and is more easily inserted than removed. The barrier may be provided as part of a system which includes a tool for performing field replacement of the barrier.

17 Claims, 12 Drawing Sheets

PRESS-FIT SOUND DAMPING STRUCTURE

This application is a continuation-in-part of U.S. patent application Ser. No. 08/378,812 filed Jan. 27, 1995 entitled PRESS-FIT EAR WAX BARRIER.

FIELD OF THE INVENTION

This invention pertains to sound attenuating/damping structures for hearing aids. More particularly, this invention pertains to press-fit inserts for in-the-ear and in-the-canal type hearing aids, which structures include sound attenuating/damping screens.

BACKGROUND OF THE INVENTION

In-the-ear and in-the-canal type hearing aids have become accepted by users for their small size, ease of use and relative comfort, as compared to older style hearing aids. Many of the in-the-ear and in-the-canal type devices include a housing or shell which is designed to fit in the ear or ear canal of the user.

The shell may hold the electronic circuitry, a microphone, and a receiver. The microphone receives audible sound from outside of the device and responsively creates an electronic signal. The signal may be sent to processing circuitry which supplies an output signal to the receiver. The receiver in turn, provides audio output to the ear.

Typically, in the in-the-ear and in-the-canal type devices, sound travels from an output port of the receiver, through a sound channel, and out of the device through an acoustical output port in the hearing aid shell. The sound then travels through the user's ear canal and causes the tympanic membrane to vibrate.

Ears secrete a substance known as cerumen or ear wax. While ear wax cleans the internal structure of the ear, it also tends to flow into the sound channel and receiver of a hearing aid located in the ear. Ear wax which migrates into a hearing aid can degrade the effectiveness of the device and can eventually cause the device to fail.

A number of barrier products are presently available to prevent or reduce the migration of ear wax into a hearing aid. One such barrier design uses a fine mesh screen in the sound channel between the receiver and acoustical output port of the shell.

More recently, barrier systems have been introduced which include a housing which threadedly interconnects the output port of the receiver and the acoustic port of the shell. The housing threads into a portion of the shell. The housing has an interior surface which includes projections extending inwardly thereof, creating a tortuous path for solid or semi-liquid ear wax migrating therethrough.

Such devices are disclosed in Weiss, U.S. Pat. No. 4,870,689, entitled "Ear Wax Barrier For A Hearing Aid" and Weiss et al., U.S. Pat. No. 4,972,488, entitled "Ear Wax Barrier And Acoustic Attenuator For A Hearing Aid," both of which patents are commonly assigned herewith, and both of which patents are incorporated by reference herein.

In the devices disclosed in the Weiss and Weiss et al. patents, the barrier is incorporated into a housing, which has projections extending inward of the housing. The barrier is then threaded into the hearing aid shell. This design was a significant improvement over devices prior thereto.

In addition, attenuation/damping of the sound transmitted by hearing aids assists the user in understanding and perceiving nearby sounds and conversation. Prior wax barriers have also exhibited attenuation and damping characteristics.

There continues to be a need for damping/attenuating structures which are easily inserted into and removed from housings or shells for hearing aids without additional mechanical components and/or shell alterations. Preferably, such structures would also facilitate field installation of one of a plurality of screens having predetermined attenuating/damping characteristics in the hearing aid.

SUMMARY OF THE INVENTION

A color coded family of attenuating/damping elements can be used to adjust the acoustic characteristics of a hearing aid. The members of the family each include a common housing which is adapted to be field installable at the acoustic output port of the aid.

Various members of the family can be field evaluated to determine the most appropriate attenuating/damping characteristics for a particular user. The members of the family could, be alternately, positioned adjacent to the receiver output port or between the receiver output port and the acoustic output port of the aid.

In one embodiment, each housing of a plurality is configured to carry one of a plurality of damping screens. The housings can be color coded to indicate the degree of attenuation or damping.

Each of the screens has a sound damping characteristic which differs from the corresponding characteristics of the other damping screens. The sound damping characteristics may be defined by, for example, the number, size and position of openings in the screens.

The damping screens include openings having a predetermined width and height. The openings may also be spaced from each other at predetermined distances in the width direction and in the height direction to alter the sound damping characteristics.

In yet another aspect of the invention, a plurality of housings can exhibit different attenuating/damping characteristics in accordance with a diameter parameter of an audio channel which extends through each respective housing. Various of the housings include channels of different diameters. Hence, a family of field or user changeable housings can exhibit a family of varying acoustic or attenuating characteristics.

In yet another aspect, the structure can also function as a wax guard. Indicators other than color could be used to indicate the degree of damping.

The housing may also serve as a press-fit connector to releasably couple, for example, the receiver output port to a receiver tube or channel, positioned between the receiver and the hearing aid shell. A press-fit structure of the type described can be used in combination with the releasable receiver connector.

Other features and advantages of the present invention will be apparent from the following detailed description, the accompanying drawings, and the appended claims.

DETAILED DESCRIPTION OF THE PREFERRED EMBODIMENTS

Figure 1:
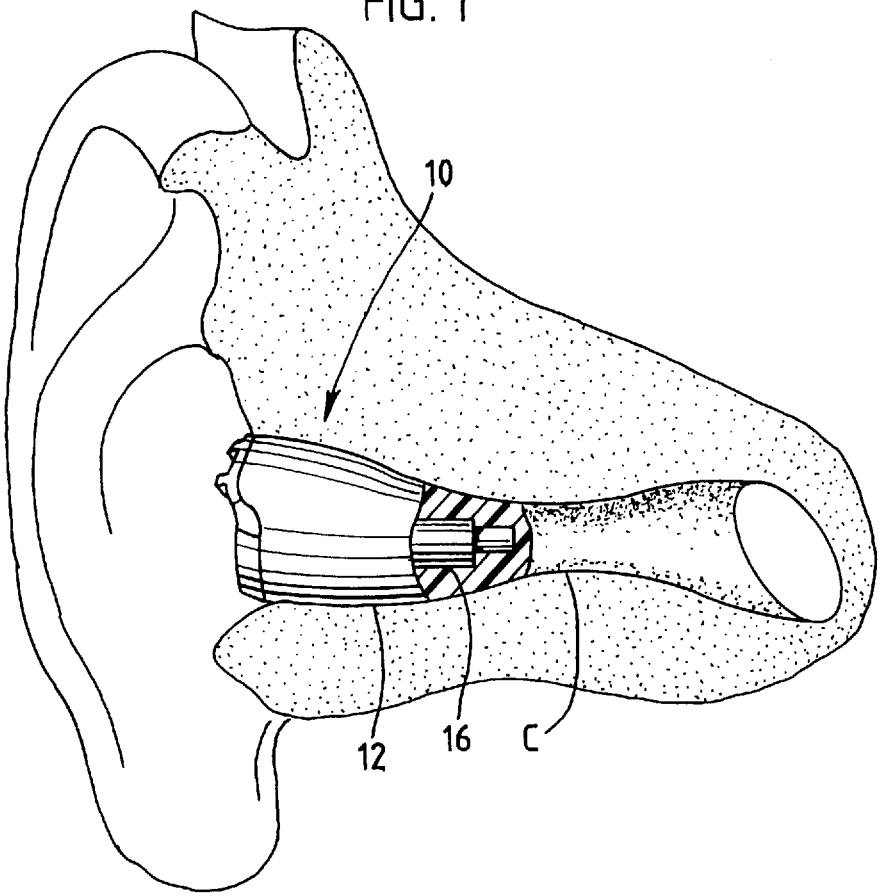
FIG. 1 is a partially broken away view of a hearing aid positioned in the ear canal of a user.

While the present invention is susceptible of embodiment in various forms, there is shown in the drawings and will hereinafter be described preferred embodiments with the understanding that the present disclosure is to be considered an exemplification of the invention and is not intended to limit the invention to the specific embodiments illustrated.

FIG. 1 illustrates an in-the-ear type hearing aid 10 positioned in the ear canal C of a user. It will be understood that the following comments also apply to in-the-canal type hearing aids.

Figure 2:
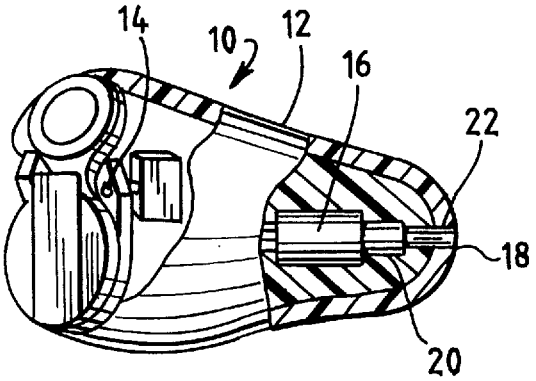
FIG. 2 is a partially broken away, perspective view of the device of FIG. 1.

As best seen in FIG. 2, the hearing aid 10 includes a shell 12, which supports or encloses a microphone 14, processing circuitry (not shown) and a receiver 16.

The shell 12 and receiver 16 each include an acoustic output port 18 and 20, respectively. In a typical arrangement, sounds from outside of the hearing aid 10 are received at the microphone 14. The microphone 14 converts the sound into an electrical signal which is processed in the circuitry.

A responsive electrical signal is transmitted by the processing circuitry to the receiver 16 which, in turn, creates an audio output. The audio output is transmitted from the receiver output port 20, via a receiver tube or channel 22 to the shell output port 18. The sound output may then be received at, and vibrate, the user's tympanic membrane, creating distinguishable sounds.

Figure 3:
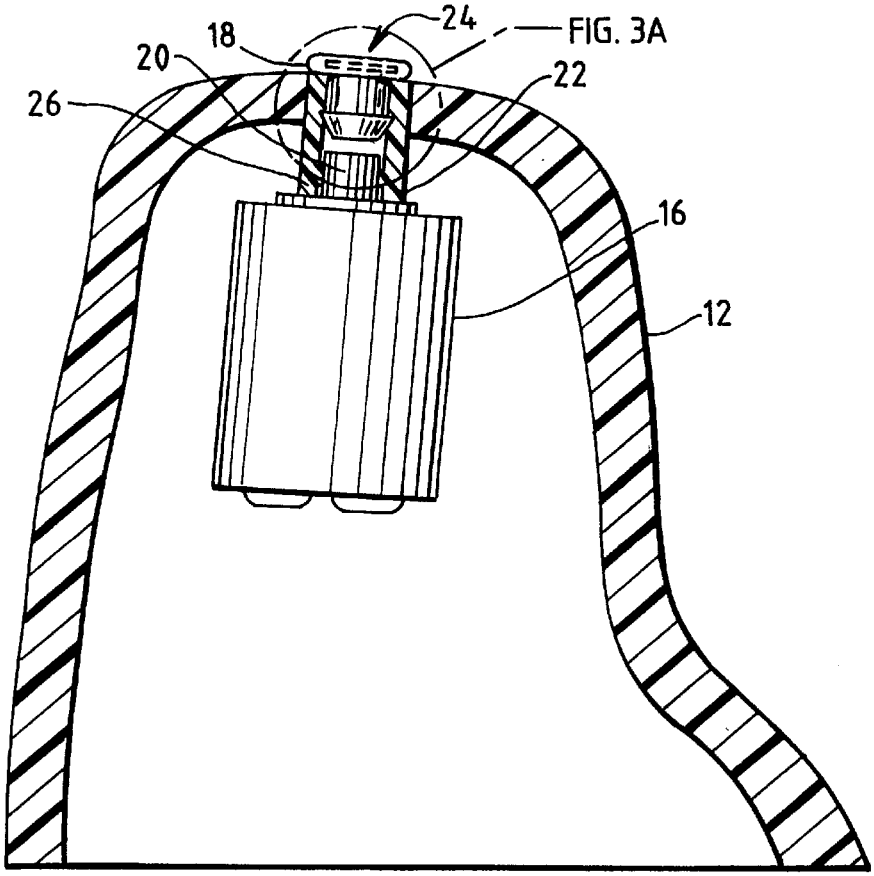
FIG. 3 is a partial cross-sectional view of a hearing aid shell having a receiver and an ear wax barrier positioned therein.

In one embodiment of the present invention, illustrated in FIG. 3, the receiver tube 22 interconnects the receiver 16 and the shell 12. The tube 22 penetrates the shell 12 at a location of the shell 12 which is positioned in the ear canal C. An ear wax barrier 24 is positioned in the tube 22 at a distal most portion 26 thereof. It will be understood that the nature and form of the shell 12 are not limitations of the present invention.

Figure 3A:
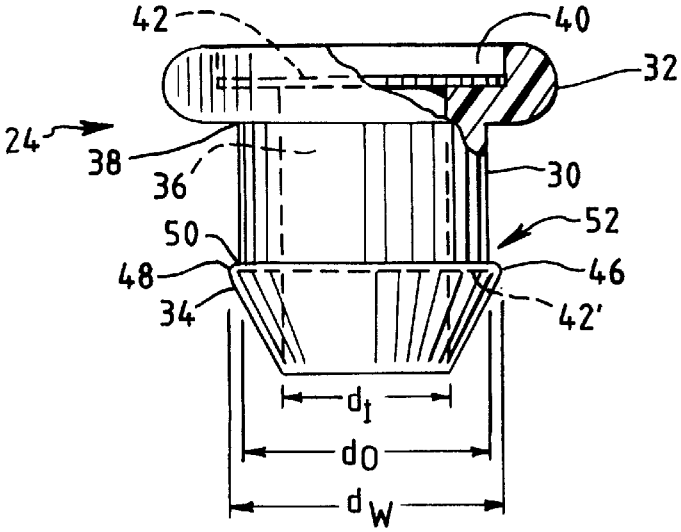
FIG. 3*a* is an enlarged, side elevational view of the ear wax barrier of FIG. 3, showing in broken lines, a central passageway.

Referring now to FIG. 3*a*, the barrier 24 includes a housing 30, a collar portion 32, and a barb 34. The housing 30 is cylindrical and includes a substantially cylindrical, central acoustical passageway 36 therethrough. The passageway provides acoustical communication between the receiver output port 20 and the shell output port 18.

The collar 32 which is located at a distal end 38 of the housing 30 has a larger diameter than the housing 30. The collar 32 prevents over-insertion of the barrier 24 into the tube 22. The collar may also include a recessed, preferably circular area, shown generally at 40, for receiving, for example, a barrier screen 42. In an alternate configuration, a barrier screen 42 may be positioned internal to the barrier 24, at a location approximately corresponding to the barb 34.

The size and number of openings in the screens 42, 42' may be varied as would be understood by those of skill in the art. The screens 42, 42' may also function as attenuators.

The barb 34 is located distally of the collar 32, and has a generally fruste-conical shape. The barb 34 surrounds the housing 30 and tapers to a diameter about equal to the inner diameter $d_I$ of the housing 30. The widest portion 46 of the barb 34, which is at a base portion 48 thereof, has a diameter $d_W$ larger than an outer diameter $d_O$ of the housing 30. A lip 50 is formed at the juncture, shown generally at 52, of the barb's widest portion 46 and the housing 30.

Figure 4:
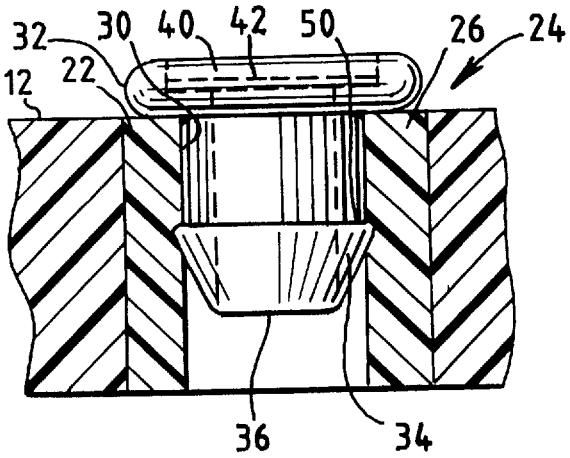
FIG. 4 is an enlarged, partial cross-sectional view of an ear wax barrier positioned in a receiver tube, in the shell of a hearing aid.

As shown in FIG. 4, the barrier 24 can be readily inserted, or press-fitted, without rotation, into the tube 22, without interference from the barb 34. The barrier 24, however, resists removal or dislodging by the frictional engagement of the lip 50 with the tube 22.

It will be understood that other forms of releasibly engageable structures could be used without departing from the spirit and scope of the present invention. For example, instead of a laterally protruding barb as illustrated, a ball and socket or a ring and a slot arrangement could be used to releasably couple the barrier element to a respective acoustic output port.

Figure 5:
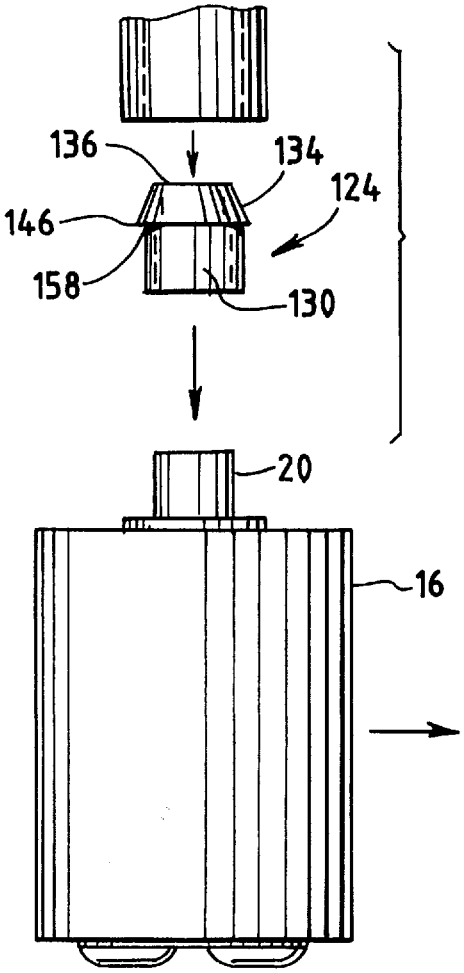
FIG. 5 is an exploded illustration of an exemplary arrangement for mounting the barrier between a receiver and a receiver tube.
Figure 5A:
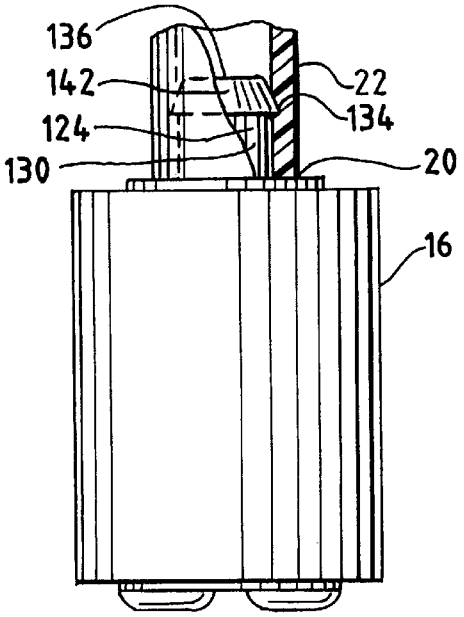
FIG. 5*a* illustrates the exemplary arrangement of FIG. 5, in the assembled configuration.

FIGS. 5 and 5*a* illustrate an alternate embodiment 124 which can function only as a connector or as a connector/barrier. The element 124 is collar-less. In the illustrated configuration, the element 124 is positioned adjacent to the receiver 16. In this arrangement, the element 124 is positioned on the receiver 16 at the receiver output port 20. The element 124 couples the receiver 16 to the receiver tube 22.

The element 124 could be integrally formed as a part of the output port 20, with or without a barrier screen such as 142. Alternately, the element 124 may be glued to the receiver output port 20.

The element 124 is positioned such that the barb 134 is directed away from the receiver 16, into the tube 22. This configuration makes it possible to releasably couple the receiver 16 to the audio output tube 22.

Figure 6:
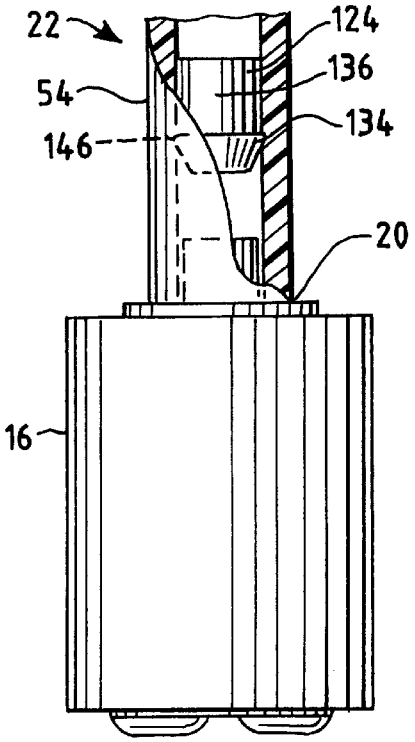
FIG. 6 is an alternate arrangement for mounting the ear wax barrier.

Another arrangement for mounting the element 124, is shown in FIG. 6. In this configuration, the element 124 is positioned in the tube 22 with the barb 134 directed toward the receiver 16. The element 124 can function as an attenuator or a wax guard in this configuration.

However, unlike the arrangement illustrated in FIGS. 5 and 5*a*, the element 124 shown in FIG. 6 is positioned at an intermediate portion 54 of the tube 22, between the receiver output port 20 and the shell output port 18. In this configuration, the tube 22 is mounted to the receiver 16, by methods which will be readily recognized by those skilled in the art, or as will be described later.

Figure 7:
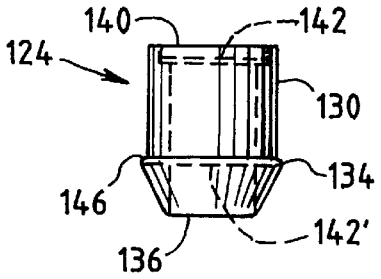
FIG. 7 illustrates the ear wax barrier of FIG. 6 including a barrier screen or an acoustic attenuator screen positioned therein.

As shown in FIG. 7, the collar-less element 124 can include a recessed area 140 which is adapted to receive, for example, a barrier or attenuator screen 142, or like device. Alternately, a barrier or attenuator screen 142' may be positioned internal to the element 124, at a location approximately corresponding to the barb 134.

Figure 8:
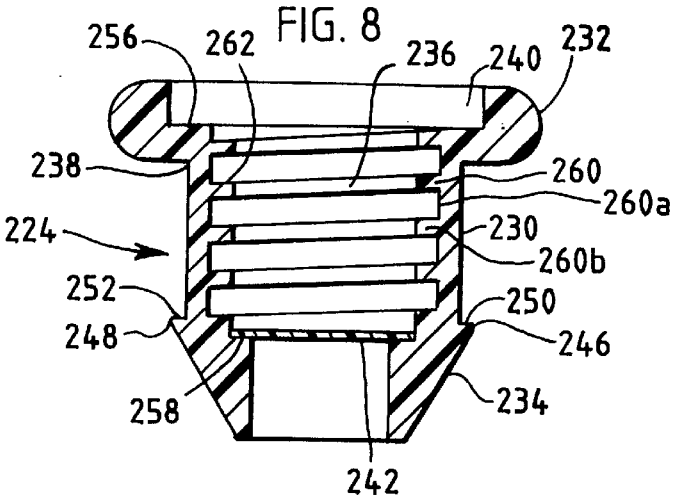
FIG. 8 is a cross-sectional view of an alternate embodiment of the ear wax barrier.

FIGS. 8–13 illustrate various embodiments of barriers in accordance with the principles of the present invention. FIG. 8 shows an embodiment 224 of the barrier having a housing 230, a collar portion 232, and a barb 234. The housing 230 defines a substantially cylindrical, central passageway 236 therethrough, which provides acoustical communication between the receiver output port 20 and the shell output port 18.

The embodiment illustrated in FIG. 8 includes the recessed area 240 at the collar portion 232, the juncture of which defines a first shoulder 256. A second shoulder 258 is formed internal to the housing 230 at a location which approximately corresponds to the widest portion of the barb 246.

The barrier 224 includes a plurality of undulations, shown as a thread 260, formed in the interior surface 262 thereof. The thread 260 is formed of a root 260*a* and a crest 260*b*, and creates a tortuous path for the migration of ear wax into the hearing aid 10. Essentially, the thread 260 defines traps by providing wax accumulation sites along the root 260*a* and the crest 260*b*, as well as across the thread 260.

The thread 260 may be formed in a continuous manner; alternately, the thread 260 may be formed in discrete sections. The thread 260 may also be formed as ridges (not shown) along the interior surface 262 of the housing 230.

In a preferred embodiment, the thread 260 extends between the first shoulder 256 and the second shoulder 258. The barrier 224 may also include, as previously discussed, a barrier screen 242. The screen 242 extends across the passageway 236, and may be positioned on either the first or second shoulder 256 or 258, respectively.

Figure 9:
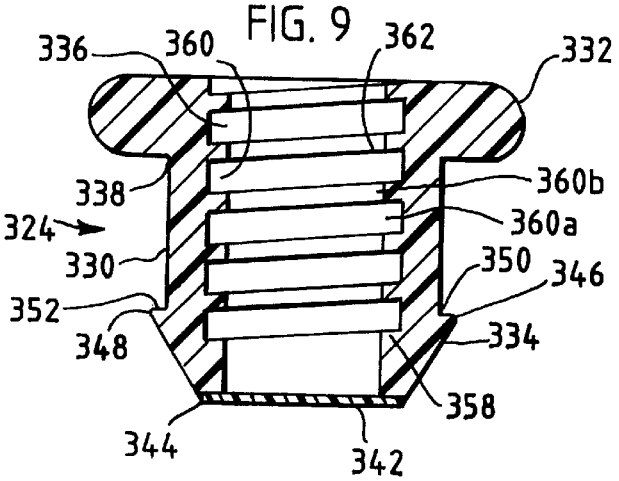
FIG. 9 is a cross-sectional view of still another embodiment of the ear wax barrier.

An alternate embodiment 324 is shown in FIG. 9. The barrier 324 is similar to that shown in FIG. 8, and includes, a housing 330, a collar portion 332, and a barb 334. The housing 330 defines a substantially cylindrical, central passageway 336 therethrough, which provides acoustical communication between the receiver output port 20 and the shell output port 18.

The embodiment 324 of the barrier illustrated in FIG. 9, includes the shoulder 358 internal to the housing 330, approximately positioned to correspond to the widest portion 346 of the barb 334. A thread 360 similar to that formed in the embodiment shown in FIG. 8, extends from about the collar 332 to the shoulder 358.

The embodiment shown in FIG. 9, however, does not include a recessed area at the collar portion 332. Rather, a barrier screen 342, if used, can be positioned across the shoulder 358. Alternately, the screen can be affixed to the barrier, at the proximal end 344 of the housing 330 adjacent to the barb 334.

Figure 10:
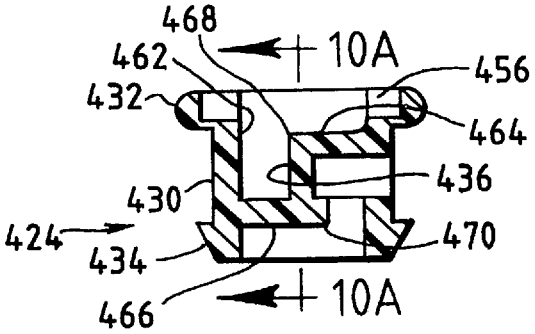
FIG. 10 is a cross-sectional view of still another embodiment of the ear wax barrier.
Figure 10A:
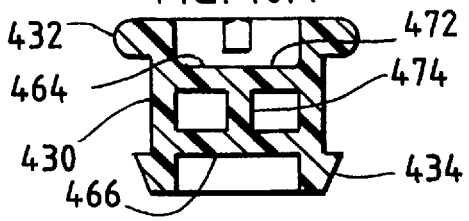
FIG. 10*a* is a cross-sectional view of the ear wax barrier of FIG. 10 taken along line 10*a*—10*a* of FIG. 10.

Another embodiment 424 is illustrated in FIGS. 10 and 10*a*. In this embodiment, upper and lower projections 464 and 466 extend inwardly of the barrier 424 opposing each other. The projections 464, 466 occlude the passageway 436 creating a tortuous path for the migration of ear wax. The projections 464, 466 terminate in ends 468 and 470, respectively. A rib 474 extends between the terminal ends 468 and 470, and provides additional wax accumulation sites.

Figure 11:
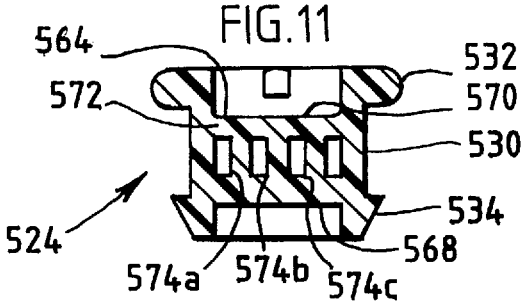
FIGS. 11 and 12 are cross-sectional views of still other embodiments of the ear wax barrier.

FIG. 11 shows an embodiment similar to that shown in FIGS. 10 and 10*a*. This embodiment of the barrier 524 incorporates a plurality of ribs 574*a–c*, extending between terminal ends 568 and 570, thus providing further wax accumulation sites.

Figure 12:
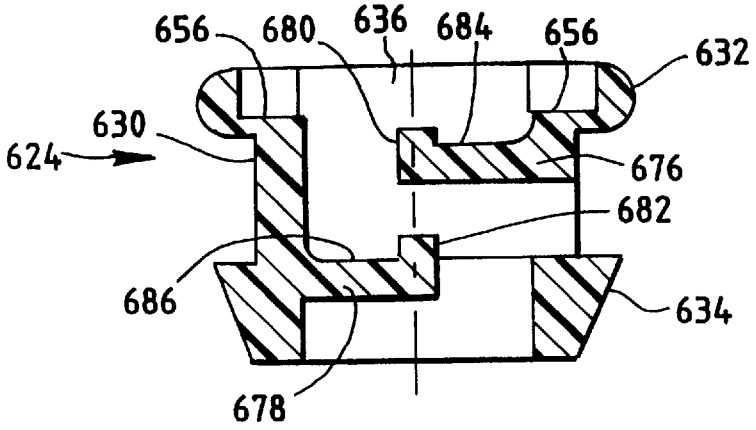

Still another embodiment 624 is shown in FIG. 12. The barrier 624 includes upper and lower projections 676 and 678, respectively, which extend inwardly of the barrier 624, and which occlude the passageway 636. Each of the projections 676 and 678 includes an upwardly extending flange portion 680, 682, respectively. The projections 676, 678, and flanges 680, 682, define trap means by providing wax accumulation sites 684 and 686, thereon.

Figure 13:
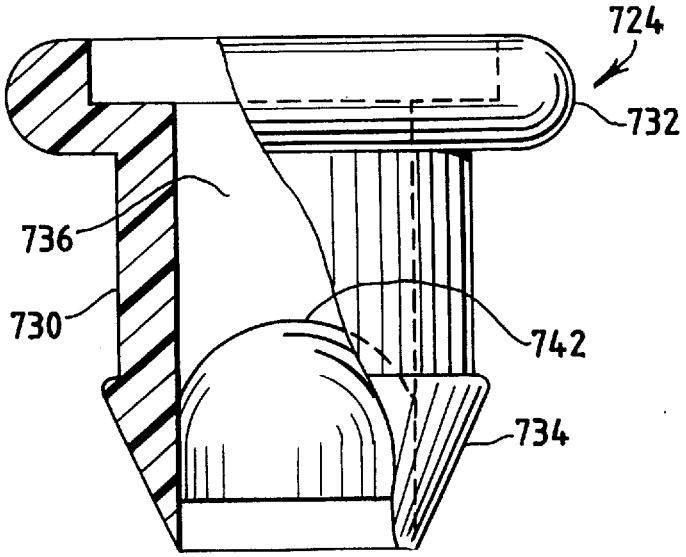
FIG. 13 is a cross-sectional view of an embodiment of the barrier having a curved or non-planar barrier screen.

Another embodiment 724 is shown in FIG. 13. This embodiment includes a barb 734 and a collar portion 732 on opposing sides of a housing 730. The housing 730 defines an uninterrupted central acoustical passageway 736 therethrough.

The barrier includes a barrier screen 742 positioned internal to the passageway 736, at a location approximately corresponding to the barb 734. In this embodiment of the barrier 724, the screen 742 is curved or formed concave relative to the barb 734. Other curved or non-planar arrangements are also possible.

Figure 14:
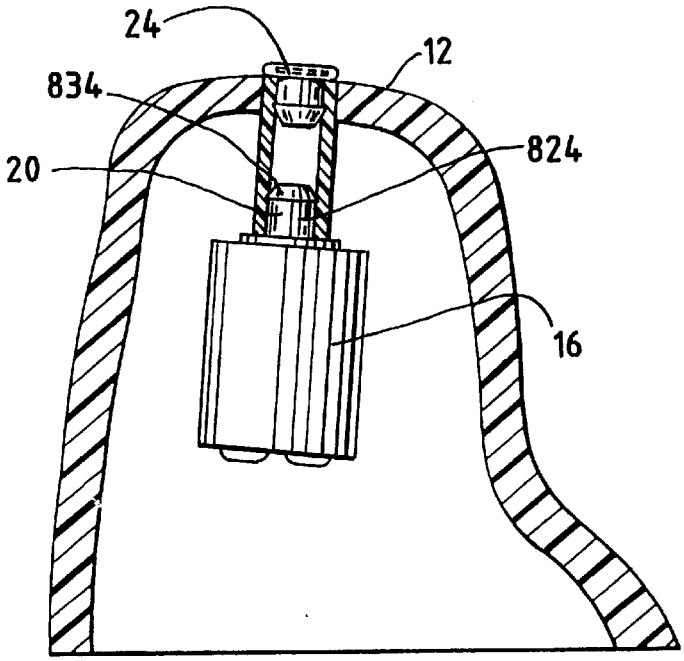
FIG. 14 is a partial cross-sectional view of a hearing aid shell having a receiver and an ear wax barrier positioned therein, the receiver being mounted to the hearing aid by a press-fit connector.

As shown in FIG. 14, one form 824 of the element may be used as a connector. The connector 824 may be mounted to, for example, a receiver output port 20, such as by gluing.

One end of a receiver tube or channel 22 may be connected to the barbed end 834 of the connector 824 to effect the connection. The other end of the tube 22 may be connected to a barrier (shown at 24) mounted to the tube 22 at the hearing aid shell 12.

Figure 15:
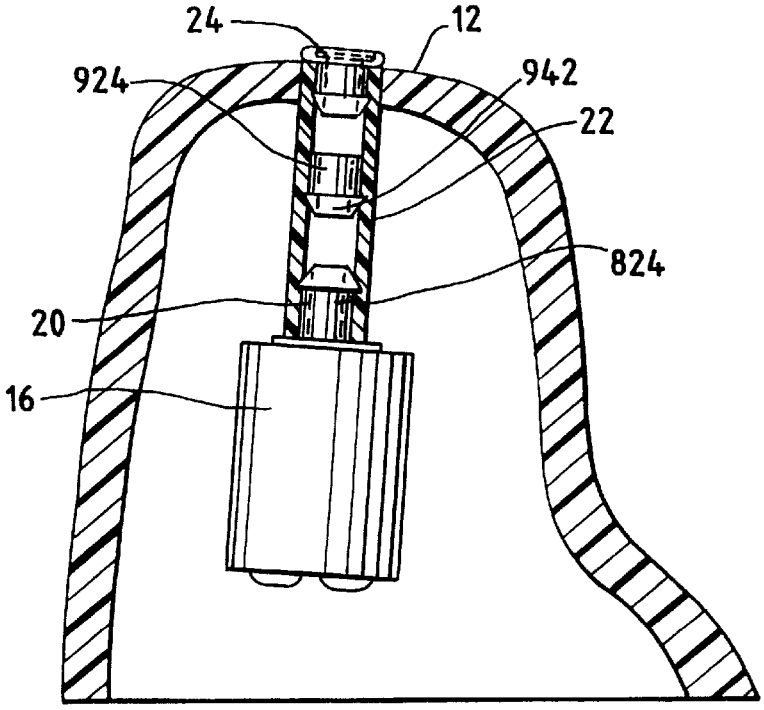
FIG. 15 is a view similar to FIG. 14, with the hearing aid further including an acoustic attenuator configured as a barrier.

FIG. 15 illustrates an alternate configuration. A connector 824 is mounted to the receiver output port 20. One end of the tube or channel 22 is mounted to the connector 824. The other end of the tube 22 is connected to a barrier 24 mounted to the tube 22 at the hearing aid shell 12.

An in-line attenuator 924 is positioned in the tube 22 intermediate the barrier 24 and the connector 824. The attenuator 924 may reduce or eliminate feedback or oscillations, or may smooth the frequency response characteristics in the hearing aid 10 circuitry.

The attenuator 924 may include a perforated member, such as a screen 942. The screen 942 perforations may be varied to produce differing attenuation characteristics.

Figure 16:
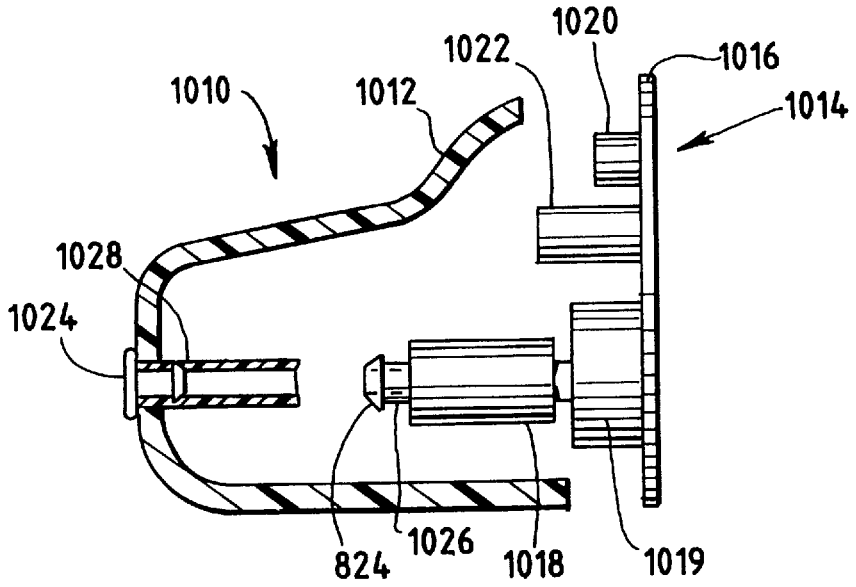
FIG. 16 illustrates an embodiment of a modular hearing aid with a press-fit connector carried by a receiver.

As shown in FIG. 16, one embodiment 1010 of a modular hearing aid includes a shell 1012 and a modular, removable circuit portion 1014. The circuit portion 1014 includes a mounting plate 1016, which may serve as an outer part of the hearing aid shell 1012. The plate 1016 is attached to the shell 1012 in normal operation.

The mounting plate 1016 may carry a receiver 1018 and processing circuitry 1019 coupled thereto. A microphone 1020 and a battery 1022 are carried on the plate 1016 and are coupled to the circuitry 1019. The receiver 1018 has a barbed connector 824, such as the connector shown in FIG. 14, attached to a receiver output port 1026.

The shell 1012 includes a tube or channel 1028 mounted thereto. A barrier 1024, exemplary of which is the barrier illustrated in FIG. 3, is mounted to the tube 1028, at the shell 1012.

The modular circuit portion 1014 can be mounted to the shell 1012 with the connector 824 press-fitted to the tube 1028. This configuration permits easy separation of the shell 1012 from the circuit portion 1014 to facilitate maintenance of the hearing aid 1010. This configuration also permits replacement of the circuit portion 1014, without necessarily replacing or manufacturing a custom shell 1012.

Thus, ear wax barriers 24, 124, 224, 324, 424, 524, 624, 724 and 824 are disclosed for use with in-the-ear and in-the-canal type hearing aids 10, 1010. The barriers 24, 124, 224, 324, 424, 524, 624, 724 and 824 are readily adaptable to such hearing aids 10, 1010 without additional mechanical components or alterations in the hearing aid shell. The barriers 24, 124, 224, 324, 424, 524, 624, 724 and 824 resist ear wax migration by providing a tortuous path for solid or semi-liquid ear wax which secretes from the ear canal C and tends to clog or cause failure of such hearing aids 10, 1010.

Figure 17A:
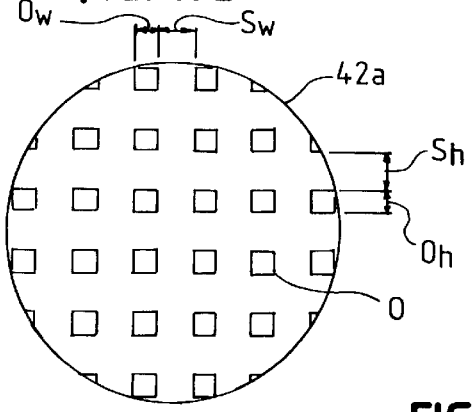
FIGS. 17*a–c* are enlarged illustrations of a plurality of screens which exhibit high, medium, and low damping characteristics, respectively.
Figure 17B:
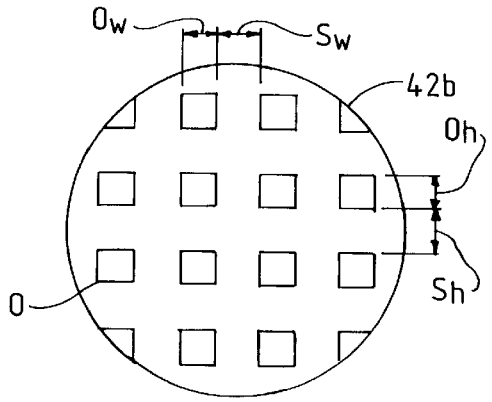
Figure 17C:
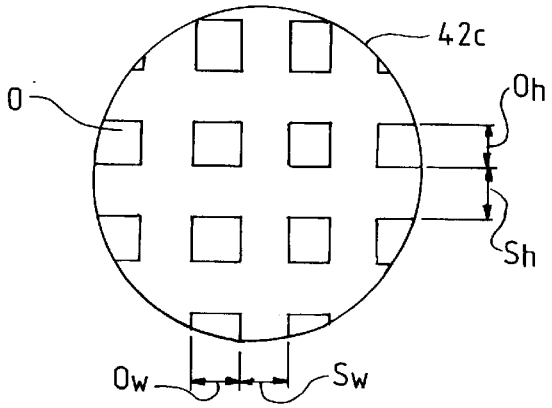

FIGS. 17*a–c* illustrate a plurality or family of different damping screens 42*a*–42*c*. The screens 42*a*–42*c* each exhibit a different damping characteristic.

Each of the screens is carried in a standardized housing, such as the housing 30. The screens 42*a*–42*c* can be located as is screen 42 or as screen 42' without departing from the spirit and scope of the present invention.

FIG. 17*a* illustrates a screen having high damping characteristics, FIG. 17*b* illustrates a screen having medium damping characteristics, and FIG. 17*c* illustrates a screen having low damping characteristics.

The housings can be color coded to indicate attenuation level. Other indicia besides color coding can be used without departing from the spirit and scope of the present invention.

Damping characteristics of the screens 42*a*–42*c* are determined by factors such as the number and size of openings O in the screens, the screen diameter, and the percentage of open area of the screen.

The open area O is a function of the opening width $O_w$ and opening height $O_h$, as well as the spacing between openings in the width dimension $S_w$ and the height dimension $S_h$. The respective dimensions can be varied to effect the desired damping characteristic for each screen. Table I illustrates characteristics of several exemplary screens.

TABLE I

| SCREEN | CENTER TO CENTER | WIDTH OF OPENING | % OF OPEN AREA |
|---|---|---|---|
| #200 | .005" | .0029" | 33.6% |
| #325 | .003" | .0017" | 30.5% |
| #400 | .0025" | .0014" | 31.4% |
| #500 | .002" | .0010" | 25.0% |
| #600 | .0017" | .00065" | 17.0% |

Figure 18:
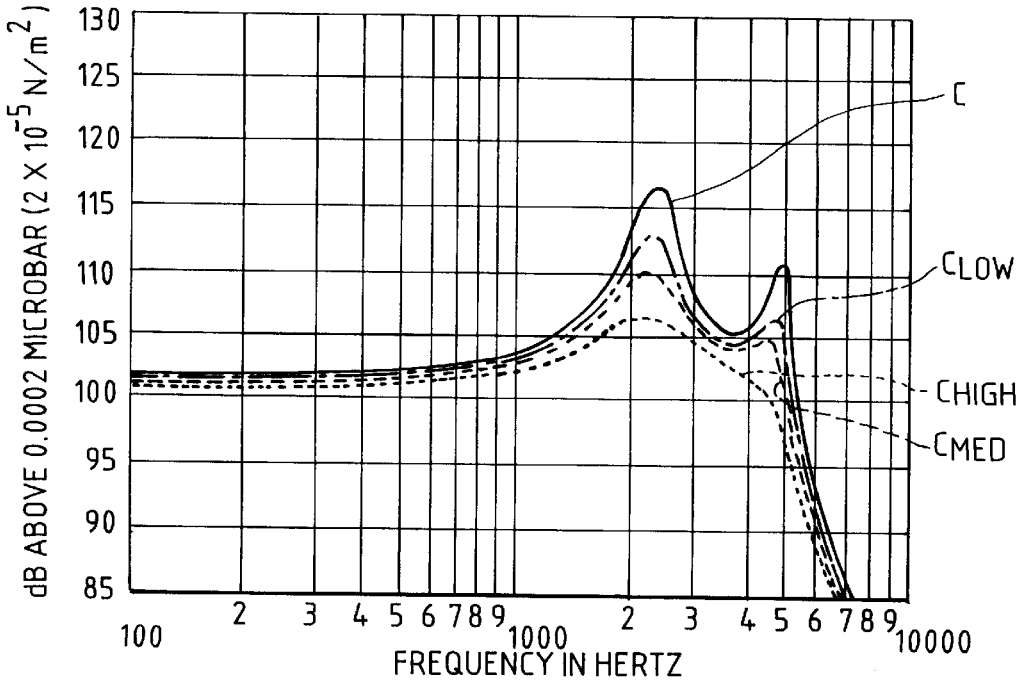
FIG. 18 is a graphical representation of damping curves that illustrate the damping characteristics of the family of screens shown in FIGS. 17*a–c.;*

Sound damping curves for different exemplary screens are illustrated in FIG. 18, as curves $C_{high}$ (screen 42*a*), $C_{med}$ (Screen 42*b*) and $C_{low}$ (Screen 42*c*). A damping curve for a housing without a damping screen is also shown in FIG. 18, as curve C. As can be readily seen from FIG. 18, the damping which is achieved with the various damping screens is substantial, particularly in the range of about 1000 to about 6000 hertz.

One of the important benefits of the present invention lies in the flexibility afforded by use of standard, color coded, housings carrying differing attenuation/damping screens. By selecting among the members of the plurality of screens 42*a*–42*c*, the characteristics of a given hearing aid can be field modified. Thus, a user can be more effectively provided with a customized output characteristic. This shall result in increased user satisfaction.

Since in one embodiment of the present invention the standardized housing is removably attached to the audio output port of the shell or housing, it can be readily removed or changed by a user or professional fitter. Hence, a user could be provided with a family of housings where each housing carried a different damping screen. In this situation, the user could select among the members of the family to obtain different performance characteristics. Finally, when so located, the structure also blocks the migration of ear wax into the aid.

Figure 19:
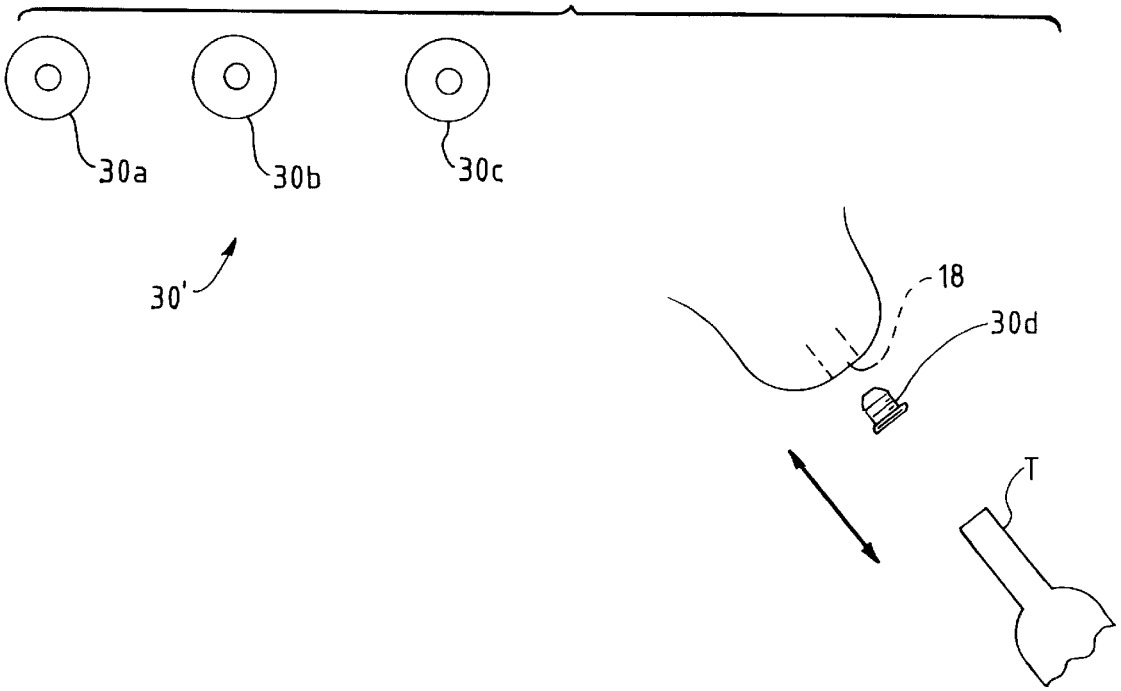
FIG. 19 illustrates a system which incorporates a plurality of different attenuator elements.

FIG. 19 illustrates a system in accordance with the present invention. A plurality of standardized, color coded, housings 30*a*–30*d* is illustrated. Each of the coded housings carries an attenuating/damping element such as one of the screens 42*a*, 42*b*, and 42*c*.

An attenuation characteristic is selected and a corresponding element, such as the element 30*d* is then field inserted into an acoustic output port 18 using a tool T. If after a trial a change is necessary, the element 30*d* can be removed and replaced with another, such as 30*c*. This change can be made by a user or a fitter. The aid need not be returned to the manufacturer. In addition, to providing damping, the elements 30*a*–30*d* also impede the flow of ear wax into the output port 18.

Figure 20A:
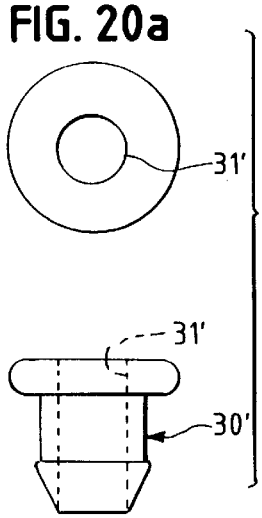
FIG. 20 illustrates an alternate embodiment of the acoustic attenuator/damping element housings, the housings in FIGS. 20*a–c* having different diameter openings therein to provide differing damping characteristics.
Figure 20B:
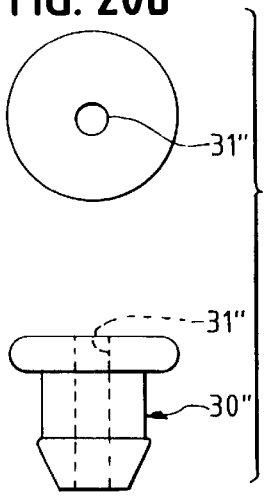
Figure 20C:
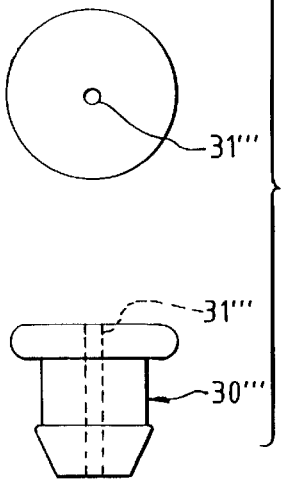

FIGS. 20*a–c* illustrate an alternate embodiment of the present invention. The members of a plurality or family of housings 30', 30" and 30'" each have different damping characteristics.

Figure 21:
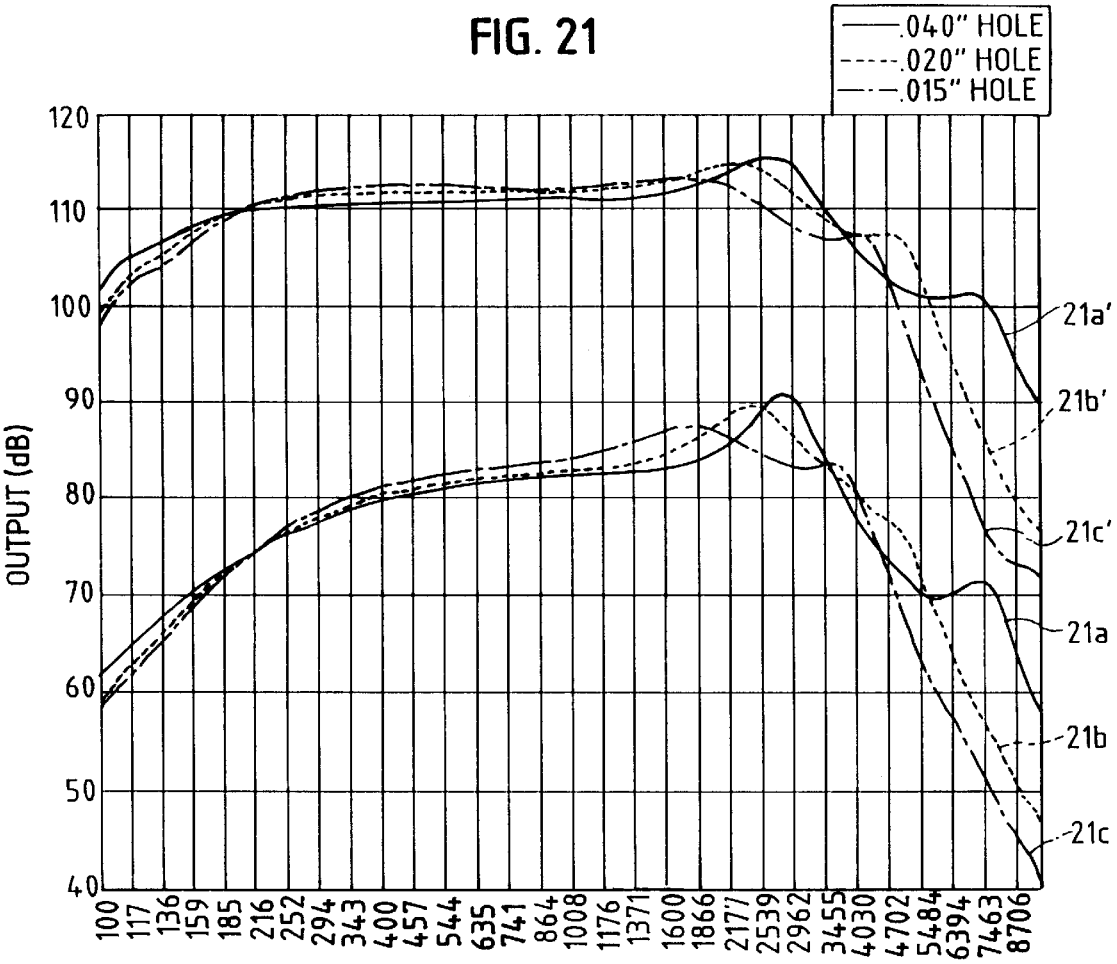
FIG. 21 is a graphical representation of damping curves that illustrate the damping characteristics of the family of housings shown in FIGS. 20*a–c*.

Each of the housings 30', 30' and 30'" exhibits different characteristics which depend, in part, on the diameter of the respective passageway or conduit 31', 31" and 31'" therein. FIG. 21 is a graphical representation of damping curves that illustrate the damping characteristics of the family of housings 30', 30" and 30'" shown in FIGS. 20*a–c*.

Curves 21*a* and 21*a*' illustrate the damping characteristics of a housing 30' having a passageway 31' with a diameter of 0.040 inches. Curve 21*a*' (Maximum Power Output Curve) illustrates the damping characteristics of the housing 30' at a higher output level than the output level of FIG. 21*a* (Gain Curve). Curves 21*b* and 21*b*' illustrate the attenuation or damping characteristics of a housing 30" having a passageway 31" with a diameter of 0.020 inches. Curve 21*b*' illustrates the damping characteristics of the housing 30" at a higher output level than the output level illustrated in curve 21*b*.

Curves 21*c* and 21*c*' illustrate the damping characteristics of a housing 30'" having a passageway 31'" with a diameter of 0.015 inches. Curve 21*c*' illustrates the damping characteristics of the housing 30'" at a higher output level than the output level illustrated in curve 21*c*.

Similar to the process using attenuation screens, 42*a–c*, an attenuation characteristic is selected and a corresponding housing, such as housing 30' is then field inserted into an acoustic output port 18 using a tool T. If after a trial a change is necessary, the housing 30' can be removed and replaced with another, such as 30". This change can be made by a user or a fitter. The aid need not be returned to the manufacturer.

An especially beneficial aspect of the availability of a plurality of housings 30', 30" and 30'" is that the peak output frequency can be shifted by selecting a housing with a different diameter. Increasing the diameter of the selected channel 31', 31" or 31'" causes the peak output to shift to a higher frequency.

Thus, where the peak output falls at a frequency where feedback is a problem, by changing to a housing with a different diameter it is possible to shift the peak output from that frequency. In this way feedback effects can be reduced or minimized.

The housings 30', 30" and 30'" can be color coded. Alternately, other forms of coding can be used to identify an attenuator or damping level.

It will be understood that the family of attenuation/damping elements can also provide an ear wax blocking function. A separate ear wax guard could be used as would be understood by those skilled in the art.

While the attenuating/damping characteristics have been described with respect to screens and housings having different acoustic characteristics, it will be understood that alternate structures could be used without departing from the spirit and scope of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. An acoustic attenuation system for use with a hearing aid which has a shell with an acoustic output port, a receiver carried within the shell and a thin walled receiver tube coupled between the receiver and the acoustic output port, the system comprising:

a plurality of substantially identical housings, each housing adapted to be received in the receiver tube at least partially intermediate the acoustic output port and the receiver said receiver tube including an acoustic passageway linking the acoustic output port and the receiver, wherein each said housing includes first and second ends; and a plurality of attenuation elements wherein members of said plurality of attenuation elements have a common shape but wherein each of said members exhibits a different audio attenuation characteristic and wherein each element is carried within a respective housing, between said ends and wherein each housing includes an exterior wall surface having a substantially cylindrical Portion of a predetermined diameter, and carries an annular coupling barb at one of the ends wherein the barb is adapted to slidably engage and compress and deform the receiver tube of the hearing aid adjacent to the acoustic-output port of the aid.

2. A system as in claim 1 wherein each of said housings includes a non-undulating acoustic channel having a substantially constant diameter which extends between said ends and a perforated, planar member which extends, at least in part, across said respective channel and wherein said perforations are different between members of said plurality.

3. A system as in claim 1 wherein:

said members of said plurality of elements exhibit different audio attenuation characteristics.

4. A system as in claim 1 wherein said housings each function as an ear wax barrier.

5. A system as in claim 1 wherein said housings each include an acoustic channel which extends between said ends, wherein each said channel has a respective diameter with some of said diameters different from others, wherein said channels exhibit different characteristics in response to said different diameters and wherein said different diameters shift in frequency an output power peak of a respective output signal.

6. A system as in claim 1 wherein said elements are color coded.

7. A system as in claim 1 which includes a removal tool for field replacement of an element.

8. A system as in claim 1 wherein said elements exhibit different peak output frequencies in response to respective ones of said audio attenuation characteristics.

9. A system as in claim 1, wherein said plurality of attenuation elements comprise sound damping screens.

10. A system as in claim 9, wherein said sound damping screens each include a plurality of openings therein, each said opening having a predetermined width and a predetermined height, and wherein each of said openings is spaced from another opening by a predetermined spacing.

11. An element for use with a hearing aid, the hearing aid having an acoustic output port and a receiver positioned therein, the receiver having a receiver output port, and a deformable thin walled receiver tube coupling the receiver output port to the acoustic output port the element comprising:

a housing adapted to be received in the receiver tube at least partially intermediate the acoustic output port and the receiver output port, said housing including an acoustic passageway linking the acoustic output port and the receiver output port;

a selected one of a plurality of sound damping screens positioned in said housing, each said sound damping screen having a predetermined sound damping characteristic differing from the other members of said plurality of sound damping screens wherein said one member of said plurality of screens is located in said housing to achieve a predetermined sound damping characteristic for the hearing aid, and wherein said housing includes an exterior wall surface having a substantially cylindrical portion of a predetermined diameter, and a retaining portion to permit press-fitting said housing into the receiver tube, adjacent to the acoustic output port thereupon deforming the receiver tube at least in the region of the retaining portion.

12. The element of claim 11 wherein said sound damping screen is located in said housing at an end, adjacent to said retaining portion.

13. The element of claim 11 wherein said sound damping screen is located in said housing at an end, displaced from said retaining portion.

14. The element of claim 11 wherein said housing includes a collar portion, and wherein said sound damping screen is located in said housing adjacent to said collar portion.

15. The element of claim 11 wherein said sound damping screen includes a plurality of openings therein, each said opening having a predetermined width and a predetermined height, and wherein each of said plurality of opening is spaced from another opening by a predetermined spacing in a first direction and a predetermined spacing in a second direction.

16. An attenuator as in claim 11 wherein said housing includes an internal shoulder within said acoustic passageway for holding said select one sound damping screen.

17. An attenuator as in claim 11 wherein said retaining portion comprises a barbed end of said housing and said select one damping screen is held adjacent said barbed end.

* * * * *